United States Patent [19]

Blanchard

[11] Patent Number: 4,941,548

[45] Date of Patent: Jul. 17, 1990

[54] FALL ARRESTING DEVICE FOR CLIMBERS

[76] Inventor: Mark W. Blanchard, P.O. Box 8030, Mammoth Lakes, Calif. 93546

[21] Appl. No.: 438,578

[22] Filed: Nov. 17, 1989

[51] Int. Cl.[5] ..... A62B 1/20

[52] U.S. Cl. ..... 182/234; 182/5; 182/239; 188/65.1

[58] Field of Search ..... 182/5, 6, 7, 234, 239; 188/65.1, 65.2

[56] References Cited

U.S. PATENT DOCUMENTS

| | | | |
|---|---|---|---|
| 285,319 | 9/1883 | Stofflet | 182/239 |
| 312,076 | 2/1885 | Bone | 182/239 |
| 978,571 | 12/1910 | Faeh | 182/239 |
| 1,113,369 | 10/1914 | Olson | 182/5 |
| 1,351,734 | 9/1920 | Barrington | 182/5 |
| 3,760,910 | 9/1973 | Koshihara . | |
| 4,602,699 | 7/1986 | Matt | 182/234 |

OTHER PUBLICATIONS

Rock Exotica, "Soloist" promotional information.

*Primary Examiner*—Reinaldo P. Machado

[57] ABSTRACT

A fall arresting device attached to a climber's safety harness having an open-sided elongated housing joined together near its center by a spindle, a drum rotatably mounted on the spindle, a clove hitch knot formed in a safety rope and tied around the drum, and a centrifugal clutch assembly on one end of the drum to halt rotation of the drum with respect to the housing plates if the rotation of the drum exceeds a predetermined rate. The housing is comprised of two housing plates which may be counterrotated about the spindle to "open" the device and allow the clove hitch knot to be tied around the drum. When the housing is "closed", by realigning the housing plates, and attached to a climbers harness via carabiners, the clove hitch knot may not be removed from the drum. When the climber pulls the device against the anchored rope at slow speeds, the clove hitch knot slips on the rotation drum and the device travels freely along the rope. If the climber should fall, the resulting high rate of travel of the device along the rope will activate the centrifugal clutch, causing the drum to stop rotating with respect to the housing and the clove hitch knot to tighten around the drum, thereby arresting the climber's fall.

16 Claims, 1 Drawing Sheet

8
10
14
12

8
34
32
32
20B
20A
30
62
30
38
42
48
44
56
24
46
50
40
52
36

34
32
20B
20A
12
30
38
40
16
42
50
52
44
48
56
56
58
24
26
60
28
64
46
62
8
36

34
20A
20B
24
8
36

FALL ARRESTING DEVICE FOR CLIMBERS

BACKGROUND

This invention relates to, but is not limited to, the mountaineering art and more specifically to a fall arresting device for solo climbers.

When two climbers ascend steep, dangerous terrain, a rope is employed to safeguard against a fall. Typically, one climber remains stationary, securely anchored to the mountain. The other climber is tied to a rope which is held by the anchored climber in such a manner that it may be fed out as the other climber ascends, yet held fast should the climber fall. In this way, potentially long falls are limited by the length of rope between the climbers. This two person technique allows a climber to concentrate fully on the task of climbing and frees him from the limitation of also having to deploy his own safety rope.

The same technique is often used by workers in various fields when a worker must venture into an area where there is risk of a dangerous fall.

When climbing alone, or solo, a climber must perform the task of two people since in addition to pulling himself up the mountain, he must also deploy his own safety rope. The most commonly used method is to anchor one end of the rope to the mountain and secure the climber to the same rope so that there is slack in the rope between the anchor and the climber. The climber may then move away from the anchor until the rope comes tight. In order to continue climbing, he must reattach himself to the rope so that there is once again slack between himself and the anchor. This technique has the disadvantage of requiring excessive slack in the rope between the anchor and the climber, which increases the distance the climber could fall. Also, in order to change his point of attachment to the rope, the climber must have at least one hand free. When climbing difficult terrain, this requirement is inconvenient if not impossible to meet.

The prior art also shows a mechanical device capable of sliding freely along a rope as the climber ascends, yet which locks securely to the rope if the climber should fall. The device must be attached to the climber in a fixed position relative to his body. Typically, a climber will ascend with the rope trailing below him. After a fall, the rope supports the climber from above. The device relies upon this change in direction of the rope to arrest the fall. A serious disadvantage of the device is that if the climber should flip upside down during the fall, or get his rope caught under his leg, the direction of pull of the rope on the device will not change, and the device will fail to arrest the climber's fall. In addition, the device requires the climber to wear a chest harness in addition to a standard sit harness in order to keep the device in a fixed position relative to the climber's body. Chest harnesses are generally disliked by climbers since they often restrict body movement and breathing.

Most solo climbers, therefore, would find it advantageous to have a fall arresting device which attaches to a common harness system, slides freely along a rope as the climber moves and reliably arrests a fall regardless of the climber's body position during the fall.

OBJECTS AND ADVANTAGES

Accordingly, the objects of my invention are: to provide a safety device which will attach a person to an anchored rope in a manner which will allow the attached person to move along the rope without having to manually to pay out rope, to provide such a device which will lock itself to the rope if the rate of travel of the device along the rope exceeds a predetermined speed, to provide such a device which is easy to attach and detach from the rope and the user's harness, and to provide such a device which is lightweight and of simple, reliable, compact design.

Readers will find further objects and advantages of the invention from a consideration of the ensuing description and the accompanying drawings.

DRAWING FIGURES

DRAWING REFERENCE NUMERALS

Figure 1:
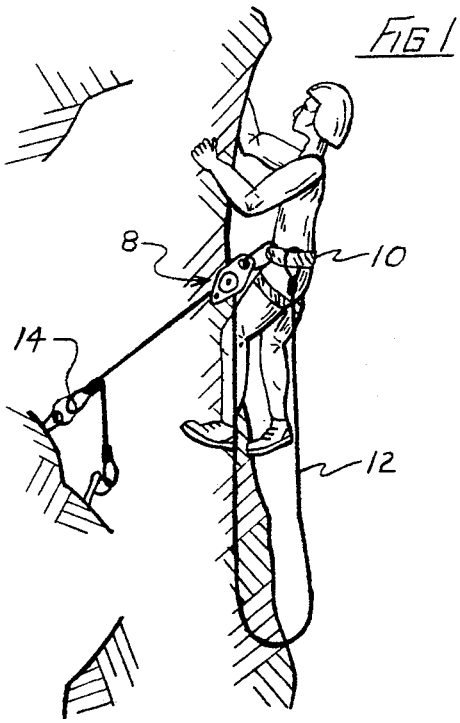
FIG. 1 is a perspective view showing the invention in use by a climber.

8 housing
10 climber's safety harness
12 safety rope
14 anchored end of 12
16 clove hitch knot in 12
20 sideplate
24 spindle
26 spindle hole in 20
28 shoulder of 24
30 inward bend in 20
32 outward bend in 20
34 attachment hole
36 rope retaining bar
38 clutch recess
40 clutch assembly
42 drum
44 textured surface of 42
46 rope guide ring
48 clutch roller platform
50 clutch roller
52 clutch spring
56 thrust washer
58 counterbore in 20
60 bearing seal
62 clutch seal
64 bearing

DESCRIPTION OF INVENTION

Figure 2:
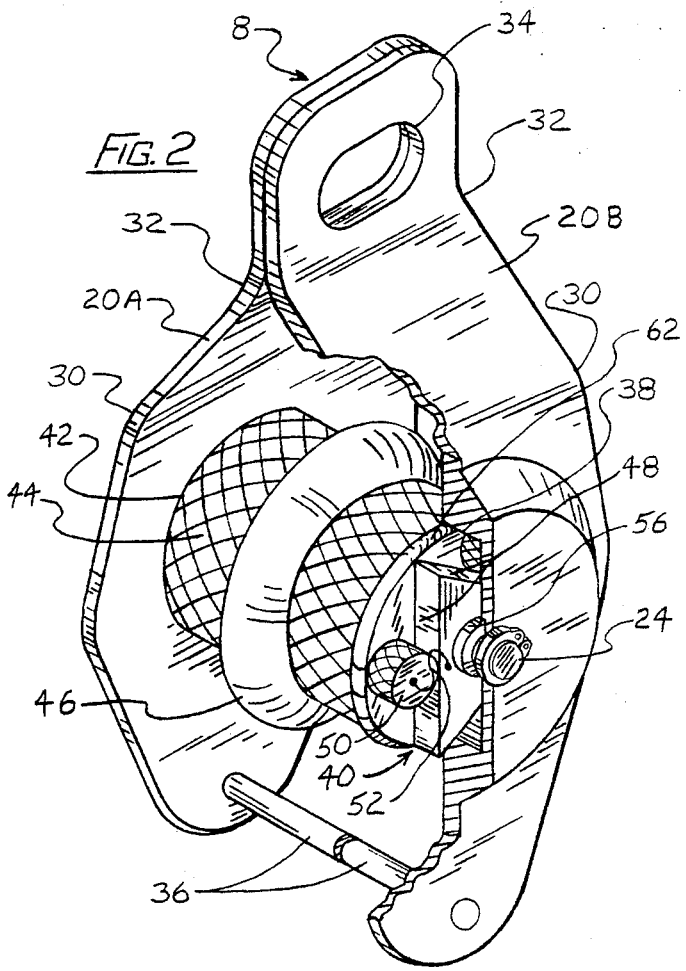
FIG. 2 shows an overall isometric view of the invention. The cutaway shows a portion of the clutch assembly.
Figure 3:
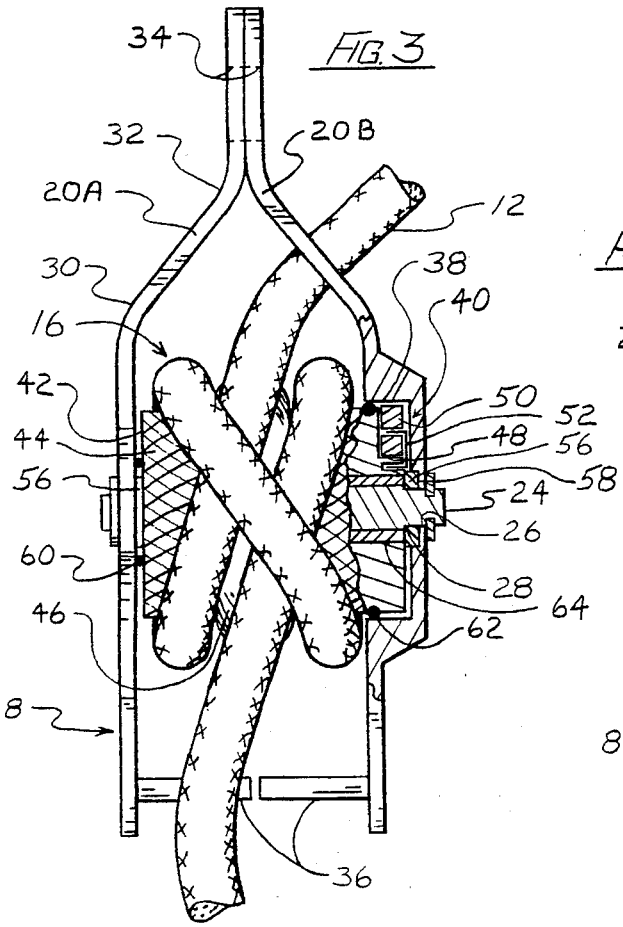
FIG. 3 is a detailed side view of the invention showing a safety rope correctly attached.
Figure 4:
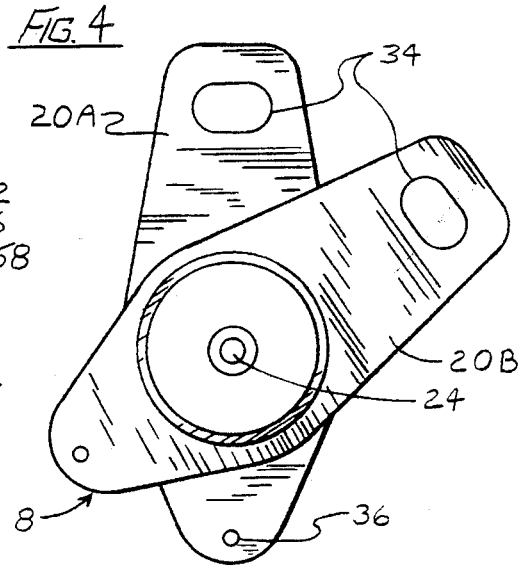
FIG. 4 is a front view showing the invention in its "open" position.

FIGS. 2, 3 and 4 show a preferred embodiment of the invention. FIGS. 2 and 3 show an elongated open-sided housing 8 comprised of two sideplates 20*a* and 20*b* joined together by a spindle 24. The spindle 24 has ends of reduced diameter thus forming shoulders 28. The sideplates 20 each have a spindle hole 26 near their center through which the spindle 24 passes. The sideplates 20 are rotatably mounted on opposite ends of the spindle 24 such that they rest firmly against the shoulders 28 of the spindle 24. Means, such as a machine nut, a spring clip, or peening, are provided at each end of the spindle 24 to prevent removal of the sideplates 20 from the spindle 24. The spindle 24 thus serves to both join together and maintain space between the sideplates 20.

As shown in FIGS. 2 and 3, the sideplates 20 each have an inward bend 30 near their middle such that they converge toward each other, and another outward bend 32 at a distance farther from the spindle hole 26 such that the end portion of their inside surfaces lie flat against each other. Near the center of this contacting area both sideplates 20 are provided with an elongated attachment hole 34, such that they may be brought into alignment by counterrotating the sideplates 20 about the spindle 24.

At the end opposite to the attachment hole 34, on each of the sideplates 20, is a rope retaining bar 36. The rope retaining bars 36 are rigidly attached to the inside surfaces of the sideplates 20 such that they are perpendicular to the sideplates 20. Each rope retaining bar 36 has a length equal to slightly less than half of the distance between the sideplates 20. When the attachment holes in the sideplates 20 are aligned, the rope retaining bars 36 are also aligned with their ends nearly touching.

The sideplates 20*a* and 20*b* are differentiated by a cylindrical clutch recess 38 on the inside surface of one of the sideplates 20*b*. The clutch recess is concentric with the spindle hole 26. A protrusion on the outside surface of the sideplate 20*b* encloses the clutch recess 38. The clutch recess 38 houses the clutch assembly 40.

The spindle 24 supports a drum 42. The drum 42 is rotatably mounted on the spindle 24 via an anti friction bearing 64. The curved outer surface of the drum 44 is textured, by a means such as knurling, to increase friction between it and a rope. Near the longitudinal center of the drum 42 is a rope guide ring 46. The rope guide ring 46 is a narrow band of increased drum diameter with rounded outer edges.

The drum 42 has a multi-sided protrusion at one end which forms several flat surfaces each lying parallel to the longitudinal axis of the drum 42. Each of these clutch roller platforms 48 supports a disc shaped clutch roller 50 which is oriented such that it may roll back and forth across the clutch roller platform 48 in a direction perpendicular to the drum's longitudinal axis. The outer curved surface of each clutch roller 50 is textured, by a means such as knurling. Clutch springs 52 are provided which attach to the center of each clutch roller 50 and the end of the drum 42. These springs provide radial tension between the clutch rollers 50 and the drum 42 which urges the clutch rollers 50 toward the center of their clutch roller platforms 48.

The clutch roller platforms 48, the clutch springs 52, and the clutch rollers 50 comprise the clutch assembly 40. The clutch assembly 40 fits inside the clutch recess 38 such that there is a small clearance between the clutch rollers 50 and the wall of the clutch recess 38.

Thrust washers 56 are provided which fit onto the reduced diameter ends of the spindle 24. One thrust washer 56 lies between the plain end of the drum 42 and the sideplate 20*a*, the other lies between the end of the drum 42 supporting the clutch assembly 40 and the sideplate 20*b*. Both sideplates 20 have a shallow counterbore 58 which is concentric with the spindle hole 26, and into which a thrust washers 56 fits. The depth of the counterbore 58 is less than the thickness of the thrust washer 56.

A bearing seal 60 which resists the transfer of dirt, grease, and liquid is provided between the sideplate 20*a* and the plain end of the drum 42. A clutch seal 62 of like function is provided between the curved outer surface of the drum 42 and the wall of the clutch recess 38.

An important part of the invention is the use of a clove hitch knot 16. FIG. 3 shows the clove hitch knot 16 formed in the safety rope 12 and correctly tied around the drum 42. The clove hitch knot 16 provides the means of attachment of the invention to the safety rope 12.

OPERATION OF THE INVENTION

FIG. 1 shows the invention in use by a climber. The invention serves as the means of attaching a climbers harness 10 to a saftey rope 12. The rope 12 should have dynamic, shock absorbing qualities and have one end tied to a secure anchor 14.

As shown in FIG. 4, to attach the invention to the rope the climber "opens" the housing 8 of the invention by rotating the sideplates 20 in opposite directions, thereby mis-aligning the attachment holes 34 and the rope retaining bars 36. As shown in FIG. 3, a clove hitch knot 16 is formed in the rope 10. The two loops of the clove hitch knot 16 are passed over a sideplate 20 and made to lie around the drum 42 with one loop on each side of the rope guide ring 46. The clove hitch knot 16 is oriented such that the portion of the clove hitch knot 16 which crosses over the rope guide ring 46 is adjacent to the attachment hole 34 in one of the sideplates 20*a*. The two strands of rope which leave the clove hitch knot 16 are oriented to extend in opposite directions and from opposite sides of the housing 8. The housing 8 of the invention is then "closed" by rotating the other sideplate 20*b* to realign the attachment holes 34 and the rope retaining bars 36. In this "closed" condition the rope 12 may not be disengaged from the housing 8 of the invention.

The housing 8 of the invention may then be attached to the climber's harness 10 via two carabiners which are passed through the attachment holes 34. The carabiners "lock" the invention "closed" by preventing the sideplates 20 from rotating with respect to each other.

When the climber moves away from the rope's anchor point 14, the rope 12 comes taut between the anchor 14 and the invention attached to the climber. As the climber continues to move away from the anchor 14, the tension in the rope 12 exerts a torque on the drum 42, causing it to rotate. The rotation of the drum 42 prevents the clove hitch knot 16 from tightening. Thus, as the climber pulls against the anchored rope 12, the clove hitch knot 16 slips, and allows the invention to travel along the rope 12. As long as the climber moves at the slow rate of speed typical of climbing, the drum 42 remains free to rotate and the invention travels freely along the rope 12. In this way, the climber may move away from his anchor without having to manually pay out rope. Furthermore, a minimum amount of rope will be deployed between the climber and his anchor, thereby minimizing slack and keeping the length of a potential fall as short as possible.

If the climber should fall, he will quickly gather speed. The rate of travel of the invention along the rope 12 will increase, and the rate of rotation of the drum 42, will likewise increase. At a predetermined rate of rotation of the drum 42 the clutch assembly 40 will suddenly halt the rotation of the drum 42 with respect to the housing 8. When the drum 42 stops rotating, friction between the drum 42 and the rope 12 will cause the clove hitch knot 16 to tighten around the drum 42. Once tight, the clove hitch knot 16 will prevent the invention from traveling further along the rope 12, and the climber's fall will be arrested. The shock absorbing qualities of the rope 12 will reduce the forces felt by the climber.

The clutch operates as follows:

When the drum 42 is at rest or rotated slowly, the clutch rollers 50 remain at the center of their clutch roller platforms 48, their position being maintained by the clutch springs 52. In this position, the clutch rollers 50 do not contact the wall of the clutch recess 38, and the drum 42 remains free to rotate about the spindle 24. When the drum 42 is rotated faster than a predetermined rate relative to the housing 8, the centrifugal force on the clutch roller 50 overcomes the centripetal spring force on the clutch roller 50. This action allows a clutch roller 50 to lift off its clutch roller platform 48 and come into contact with the wall of the clutch recess 38. As a result, the clutch roller 50 is displaced along its clutch roller platform 48 and jammed into a taper formed by the clutch roller platform 48 and the wall of the clutch recess 38, thereby stopping the rotation of the drum 42 with respect to the housing 8. Reverse rotation of the drum 42 will release the clutch roller 50 from the taper and allow the clutch spring 52 to return the clutch roller 50 to the center of its clutch roller platform 48, thereby restoring free rotation to the drum 42.

The clutch may also be activated by a very sudden increase in the rate of rotation of the drum 42. In this case the inertial mass of the clutch roller 50 causes it to accelerate slower than the drum 42. This causes the clutch roller 50 to roll along its clutch roller platform 48 and become lodged into the taper formed by the clutch roller platform 48 and the wall of the clutch recess 38. It may be released as described above.

As the above description shows, the invention provides a simple and reliable fall arresting device for solo climbers, which frees the climber from the limitation of having to manually pay out his own safety rope.

While the above description contains many specificities, the reader should not construe these as limitations on the scope of the invention, but merely as exemplifications of the preferred embodiments thereof. Many other variations are possible. For example, the invention may be made in a variety of sizes to make it adaptable for use with ropes of various sizes and strengths. The invention may be made lighter by utilizing lightweight materials and/or removing excess material from its parts, such as by drilling holes in them. The edges of the sideplates may bent so as to flare outwards, providing a smoother edge for the rope to run over. The invention may be attached to a fixed anchor and a safety rope pulled through it by a person tied to the end of the rope. The invention is also applicable to any occupational or recreational activity in which a rope is employed to protect a person or object from a dangerous fall. Accordingly, the scope of the invention should be determined not by the embodiments illustrated, but by the appended claims and their legal equivalents.

I claim:

1. A fall arresting device comprising:

a housing, a drum, means for rotatably mounting said drum within said housing, a centrifugal clutch means which halts rotation of said drum with respect to said housing when said drum reaches a predetermined rate of rotation, a clove hitch knot formed in a rope and tied around said drum, whereby said device may slide freely along said rope at less than a predetermined rate of travel yet lock securely to said rope when said rate of travel is attained.

2. The fall arresting device of claim 1 wherein said means is comprised of a spindle mounted within said housing, said drum being mounted on said spindle via anti-friction means.

3. The fall arresting device of claim 2 wherein said housing is comprised of two elongated side plates rotatably joined together near their centers by said spindle.

4. The fall arresting device of claim 3 further including a cylindrical clutch recess on the inside surface of one of said sideplates, said clutch recess being concentric with said spindle.

5. The fall arresting device of claim 3 wherein means are provided to bring the the sideplates into contact with each other at one end of said housing.

6. The fall arresting device of claim 5 wherein said means is comprised of two equal and opposite bends in each of said sideplates such that the end portion of the inside surfaces of said sideplates lie flat against each other.

7. The fall arresting device of claim 6 further including attachment means at said contacting end of said housing to allow said housing to be attached to a climber.

8. The fall arresting device of claim 7 wherein said attachment means comprise a hole through each of said sideplates such that said attachment holes may be aligned by counterrotating said sideplates about said spindle.

9. The fall arresting device of claim 8 further including rope retaining means at the end of said housing opposite to said attachment holes for preventing said clove hitch from being removed from said drum.

10. The fall arresting device of claim 9 wherein said rope retaining means is comprised of two rope retaining bars, one of said rope retaining bars being attached perpendicular to the inside surface of each of said sideplates such that the ends of said rope retaining bars nearly touch.

11. The fall arresting device of claim 10 wherein the alignment of said rope retaining bars is coincident with the alignment of said attachment holes.

12. The fall arresting device of claim 1 wherein the curved outer surface of said drum is textured, thereby improving friction between it and a rope.

13. The fall arresting device of claim 12 further including a rope guide ring located near the longitudinal center of said drum, said rope guide ring being a band of increased drum diameter with rounded outer edge.

14. The fall arresting device of claim 13 wherein said clove hitch knot is formed in a safety rope and tied around said drum with one loop of said rope lying on each side of said rope guide ring.

15. The fall arresting device of claim 4 wherein said centrifugal clutch means is comprised of: a plurality of clutch roller platforms located on one end of said drum, each of said clutch roller platform being comprised of a flat surface lying parallel to the longitudinal axis of said drum, a disc shaped clutch roller resting on said clutch roller platform and oriented so as to roll in a direction perpendicular to said drum's longitudinal axis, a clutch spring joined to said clutch roller and the end of said drum so as to provide tension between said clutch roller and said clutch roller platform, thereby urging said clutch roller to the center of said clutch roller platform, said clutch roller platforms, said clutch rollers, and said clutch springs located within said clutch recess such that there is a small clearance between said clutch rollers and the curved wall of said clutch recess.

16. A fall arresting device comprised of: a housing, a drum, means for rotatably mounting said drum within said housing, centrifugal clutch means for halting the rotation of said drum with respect to said housing when the rotation of said drum reaches a predetermined rate, a clove hitch knot formed in a rope and tied around said drum, means for opening said housing to allow said clove hitch knot to be tied around said drum, means for preventing said clove hitch knot from being disengaged from said drum.

* * * * *